US005775135A

United States Patent [19]

Shibata et al.

[11] Patent Number: 5,775,135

[45] Date of Patent: Jul. 7, 1998

[54] CIRCULAR KNITTING MACHINE WITH JACQUARD PATTERN CONTROL MECHANISM FOR CYLINDER NEEDLES, SINKERS OR DIAL NEEDLES

[75] Inventors: Takao Shibata, Osaka; Yukiari Iida, Hyogo, both of Japan

[73] Assignee: Precision Fukuhara Works, Ltd., Japan

[21] Appl. No.: 872,535

[22] Filed: Jun. 11, 1997

[30] Foreign Application Priority Data

Jun. 20, 1996 [JP] Japan ..... 8-181338

[51] Int. Cl.[6] ..... D04B 15/78

[52] U.S. Cl. ..... 66/219; 66/216

[58] Field of Search ..... 66/215, 216, 217, 66/218, 219, 220, 221

[56] References Cited

U.S. PATENT DOCUMENTS

| | | | |
|---|---|---|---|
| 4,715,198 | 12/1987 | Ploppa et al. | 66/219 |
| 4,799,366 | 1/1989 | Bertagoli | 66/219 |
| 4,989,425 | 2/1991 | Furia | 66/220 |
| 5,046,334 | 9/1991 | Maruyama et al. | 66/221 |
| 5,375,436 | 12/1994 | Fucik | 66/221 |
| 5,689,977 | 11/1997 | Yorisue et al. | 66/219 |

FOREIGN PATENT DOCUMENTS

| | | | |
|---|---|---|---|
| 2318377 | 10/1974 | Germany | 66/219 |

*Primary Examiner*—C. D. Crowder
*Assistant Examiner*—Larry D. Worrell, Jr.
*Attorney, Agent, or Firm*—Bell Seltzer Intellectual Property Law Group of Alston & Bird LLP

[57] ABSTRACT

A jacquard pattern control mechanism for a circular knitting machine in which knitting instrumentalities are selected in accordance with a jacquard pattern and are moved between three positions, namely, welt, tuck and knit positions, by a selector jack, a rocker base, a rocker bar pivotally mounted on the rocker base and control cams for controlling the knitting instrumentality, selector jack, rocker base and rocker bar and electromagnetic selection mechanisms that attract selected portions of the rocker bar to determine to which position the knitting instrumentality will be moved, and wherein the selection mechanisms are more compact and have shorter strokes to permit selection of all types of knitting instrumentalities and all three positions without reducing the number of yarn feeds.

18 Claims, 6 Drawing Sheets

CIRCULAR KNITTING MACHINE WITH JACQUARD PATTERN CONTROL MECHANISM FOR CYLINDER NEEDLES, SINKERS OR DIAL NEEDLES

FIELD OF THE INVENTION

The present invention relates to circular knitting machines and more particularly to a jacquard control mechanism for cylinder needles, sinkers or dial needles.

BACKGROUND OF THE INVENTION

Circular knitting machines are of either the single knit type or the double knit type. Single knit circular knitting machines typically include a rotating needle cylinder with knitting needles slidably mounted in grooves therein and a sinker cap with sinkers slidably mounted in grooves therein mounted on top of the needle cylinder for rotation therewith. Double knit circular knitting machines include a rotating needle cylinder and a rotating dial associated therewith. The needle cylinder has cylinder needles slidably mounted in vertical grooves therein while the dial has dial needles slidably mounted in horizontal, radial grooves therein.

In co-pending U.S. patent application Ser. No. 08/771,519, filed Dec. 23, 1996, now Pat. No. 5,689,977 assigned to the assignee of this application and which is incorporated herein by reference, there is disclosed a jacquard pattern control mechanism for a single knit circular knitting machine for control of cylinder knitting needles and sinkers. While such jacquard pattern control mechanism constitutes a considerable advance over prior jacquard pattern control mechanisms, it still has various limitations and disadvantages. Among such limitations and disadvantages is an inability to be used to control dial needles because of the requirement that the control mechanism must be made smaller so that it will fit in the space available toward the center of the dial. Also, difficulty is frequently encountered with prior such pattern control mechanisms in moving the knitting instrumentalities to the welt, tuck and knit positions.

SUMMARY OF THE INVENTION

With the foregoing in mind, it is the object of the present invention to provide a jacquard pattern control mechanism for controlling all types of knitting instrumentalities and for moving such instrumentalities between all three positions thereof.

This object of the present invention is achieved by a jacquard control mechanism for a circular knitting machine of the single knit type or double knit type in which knitting instrumentalities are slidably movable in grooves between welt, tuck and knit positions and in which a rocker base is installed in each groove with each knitting instrumentality. A selector jack is positioned in each groove between the rocker base and the knitting instrumentality, and at least one rocker is mounted for rocking movement on the rocker base and having attractable portions. At least one pair of attractors or magnetic attracting means is provided in corresponding relation to the attractable portions of the rocker. The rocker base is moved as it engages with and disengages from the selector jack to shorten the stroke, making it possible to select the three positions of the knitting instrumentality. Control cams for controlling the knitting instrumentality, control cams for controlling the selector jack, and intermediate cams for the rocker base are all provided. Additional cams are provided for controlling the rocker.

BRIEF DESCRIPTION OF THE DRAWINGS

Some of the objects and advantages of the present invention having been stated, others will appear as the description proceeds when considered in conjunction with the accompanying schematic drawings, in which.

DETAILED DESCRIPTION OF THE PREFERRED EMBODIMENTS

Figure 1:
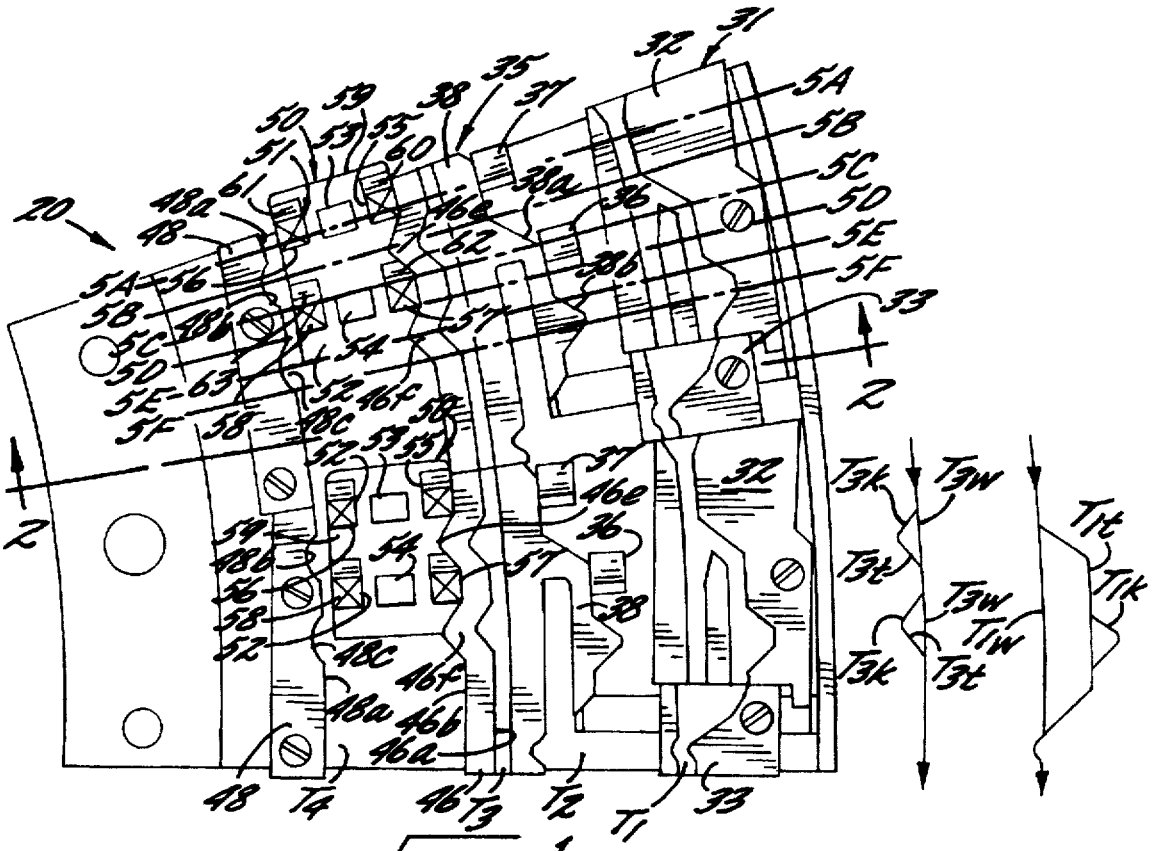
FIG. 1 is a fragmentary, schematic view of a cam block and controlling cams of the jacquard control mechanism of the present invention.
Figure 2:
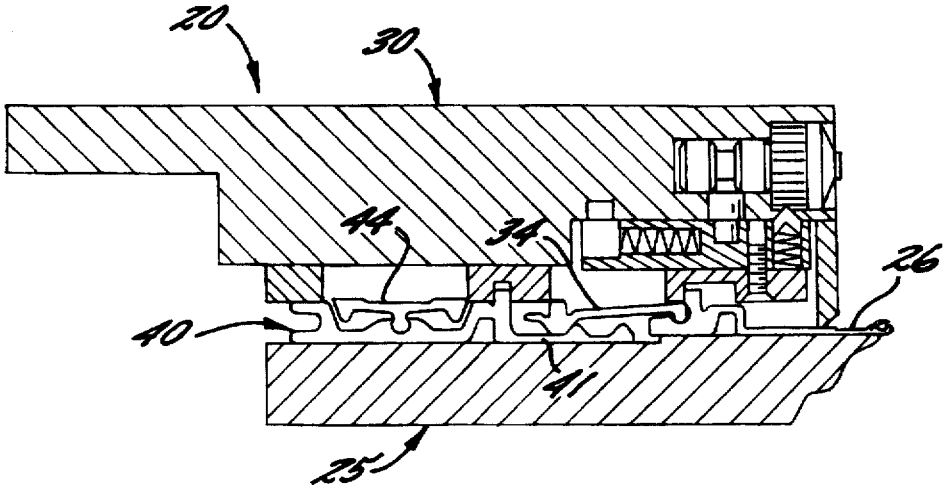
FIG. 2 is a section taken substantially along line 2—2 of FIG. 1.
Figure 3:
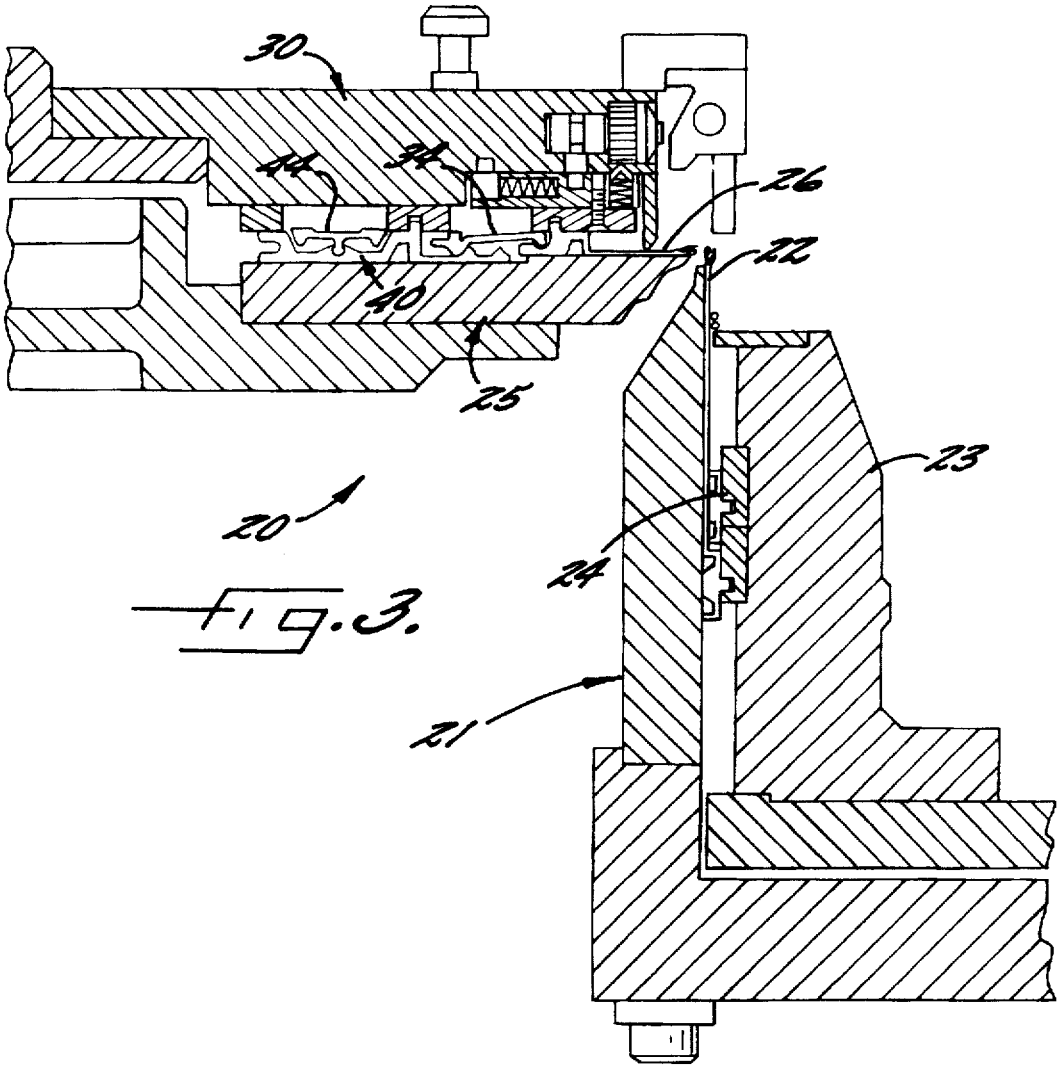
FIG. 3 is a fragmentary vertical section of a double knit circular knitting machine incorporating the pattern control mechanism of the present invention installed on the dial of the knitting machine.

Referring now more specifically to the drawings and particularly to FIGS. 1–5H, there is illustrated schematically and sectionally the core part of a circular knitting machine, generally indicated at 20, which incorporates the jacquard pattern control mechanism of the present invention. Circular knitting machine 20 includes a rotary needle cylinder 21 having a multiplicity of grooves (not shown) therein. A knitting needle 22 is mounted for vertical sliding movement in each of the grooves in the needle cylinder 21 (FIG. 3).

Circular knitting machine 20 further includes a cam block 23 mounted outside the needle cylinder 21 and mounts a needle cam 24 for raising and lowering the needles 22 between an active (knit) position and an inactive (welt) position. Additional cams may be provided for moving needles 22 to a tuck position.

A rotary dial 25 is mounted on top of the needle cylinder 21 and has a multiplicity of grooves (not shown) extending radially from the outer periphery to the inner periphery thereof. A dial needle 26 is slidably mounted in each of the grooves in dial 25 for movement between welt, tuck and knit positions. Dial needle 26 preferably has at least one butt **26*a* thereon and a semicircular indentation 26*b* in the upper surface thereof from which the butt 26*a* extends (FIG. 4**).

A dial cam block 30 is mounted above the dial 25 and mounts on its lower surface dial needle control cams, generally indicated at 31, in facing relation to the grooves in dial 25. Dial needle control cams 31 include outer guard cams 32 and stitch cams 33 which define a cam track $T_1$, for the butt **26*a* of dial needle 26. Stitch cams 33** are mounted for radial adjustment to control the density of the fabric.

Figure 4:
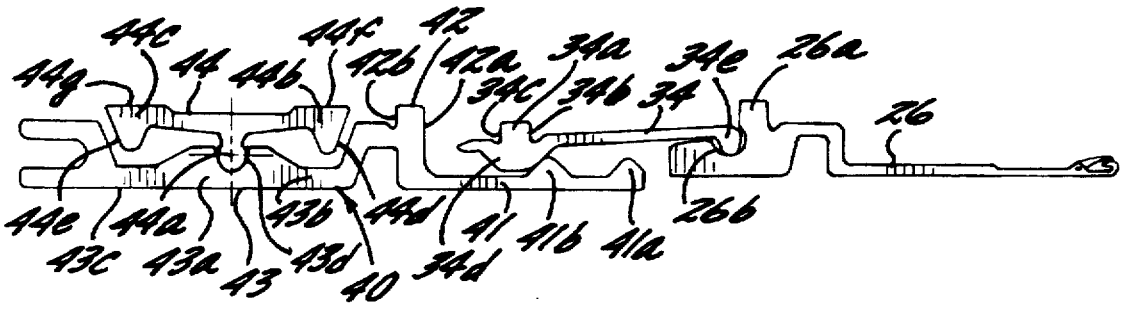
FIG. 4 is an enlarged, somewhat schematic view of the dial needle, selector jack, rocker base and rocker of the jacquard pattern control mechanism shown in FIG. 3.

A selector jack 34 is disposed in each dial groove in dial 25 outwardly of dial needle 26 (FIGS. 2–4). Selector jack 34 has a butt 34*a* thereon which has a first vertical edge 34*b* and a second vertical edge 34*c* (FIG. 4). Selector jack 34 has an inverse trapezoidal projection 34*d* from the side thereof opposite butt 34*a*. A circular projection 34*e* projects from the end portion of selector jack 34 opposite the end portion having butt 34*a* thereon, and projection 34*e* is received in indentation 26*b* on dial needle 26. Cam block 30 mounts selector jack control cams, generally indicated at 35, including cancelling cams 36, additional cancelling cams 37 and selector jack raising cams 38 defining a cam track $T_2$. Cam track $T_2$ receives butt 34*a* on selector jack 34 and controls and moves selector jack 34.

A rocker base 40 (FIGS. 2–4) is slidably mounted in each dial groove partially outwardly of selector jack 34. Rocker base 40 includes an outer end section 41, the lower portion of which is received in the dial groove and the upper portion of which includes first and second spaced apart trapezoidal projections 41*a* and 41*b* which coact with projection 34*d* on selector jack 34. Additionally, rocker base 40 includes a butt 42 projecting upwardly therefrom. Butt 42 includes a first vertical edge 42*a* and a second vertical edge 42*b*. The outer end section 41 of rocker base 40 has a first indentation 41*c* between projections 41*a* and 41*b* and a second indentation 41*d* between projection 41*b* and the first vertical edge 42*a* of butt 42 to receive therein projection 34*d* of selector jack 34.

Rocker base 40 includes a medial section 43 having a central portion 43*a* and opposite end portions 43*b* and 43*c*. The lower portion of medial section 43 is received in the dial groove, and the central portion 43*a* has a recess or socket 43*d* in the upper portion thereof.

A rocker bar 44 is mounted on the medial section 43 of rocker base 40 for pivotal movement by a circular pivot protrusion 44*a* which is received in socket 43*d*. Rocker bar 44 has symmetrical opposite end portions 44*b* and 44*c* which are beveled, wedge-shaped at their outer extremities at 44*d* and 44*e*. The lower portions of opposite end portions 44*b* and 44*c* are bulbous-shaped and serve to engage the upper edges of end portions 43*b* and 43*c* of medial section 43 of rocker base 40 to limit the pivotal movement of rocker bar 44. The upper sections 44*f* and 44*g* of end portions 44*b* and 44*c* are magnetically attractable and are raised above the central portion of rocker bar 44.

Rocker base control cam 46 is carried by cam block 30 adjacent selector jack raising cam 38. Cam 46 has a first side edge 46*a* which is spaced from side edges 38*a* of cams 38 to define therewith a cam track $T_3$ which receives and controls butt 42 on rocker base 40.

Rocker base control cam 46 has a second side edge 46*b* which is positioned to engage wedge-shaped end 44*d* of rocker bar 44 when rocker bar 44 is pivoted to have end portion 44*b* extended. First side edge 46*a* of rocker base cam 46 has spaced apart indentations 46*c* and 46*d* therein which permit rocker base 40 to be moved inwardly a short distance. Second side edge 46*b* of rocker base cam 46 has protrusions 46*e* and 46*f* opposite indentations 46*c* and 46*d* to retract rocker bar 44 and thus rocker base 40.

A rocker bar guard cam 48 is mounted on cam block 30 and has a side edge 48*a* spaced from side edge 46*b* of rocker base cam 46 a distance equal to the length of rocker bar 44 and defining therewith a cam track $T_4$. Side edge 48*a* engages the wedge-shaped end 44*e* when rocker bar 44 is pivoted to position end portion 44*c* in extended position. Cam 48 has spaced apart indentations 48*b* and 48*c* opposite and aligned with protrusions 46*e* and 46*f* on second side edge 46*b* of cam 46.

A magnetic attraction selection device, generally indicated at 50, is positioned immediately upstream of protrusions 46*e* and 46*f* of cam 46 and indentations 48*a* and 48*b* of cam 48 and above the path of travel of rocker bar 44 such that the rocker bar 44 on the rocker base 40 passes closely therebeneath.

Selection device 50 includes two pairs of magnetic attraction means 51 and 52 (FIG. 1) disposed in position to attract magnetically the magnetic attractable sections 44*f* and 44*g*, respectively, of rocker bar 44 when rocker bar 44 passes therebeneath. Preferably, the pairs of magnetic attraction means 51, 52 comprises permanent magnets 53, 54 in the center and first and second electromagnets 55, 56 and 57, 58 on opposite sides of permanent magnets 53, 54, respectively. Permanent magnets 53, 54 and electromagnets 55–58 are all supported by a support member 59. For a more complete description of this selection system, reference is made to application Ser. No. 08/771,519, now Pat. No. 5,689,977, incorporated herein by reference.

Referring now to FIGS. 5A–5H, a series of operations of the first embodiment of this invention will now be described. When an individual dial needle 26 and its associated selector jack 34, rocker base 40 and rocker bar 44 approach selection means 50, rocker cancelling cams 60, 61 place the rocker bar 44 in the neutral position shown in FIG. 5A. If it is desired to move dial needle 26 to the knit position, a signal is sent from a controller (not shown) to electromagnet 55 which attracts attractable portion 44*f* of rocker bar 44.

Figure 5A:
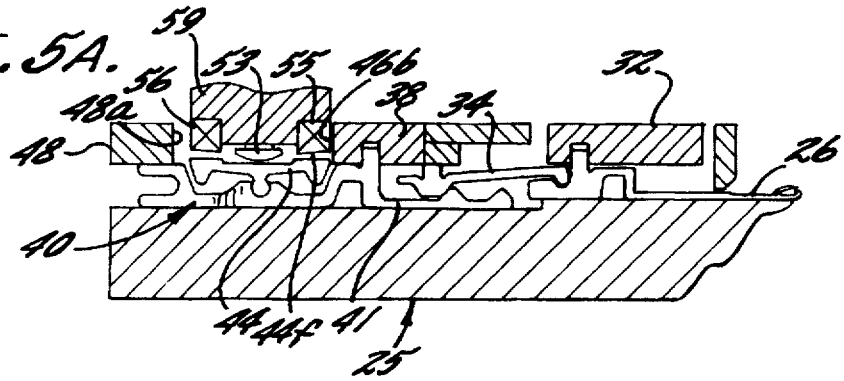
FIGS. 5A through 5F, inclusive, are sectional views taken substantially along lines 5A through 5F, inclusive, in FIG. 1.
Figure 5B:
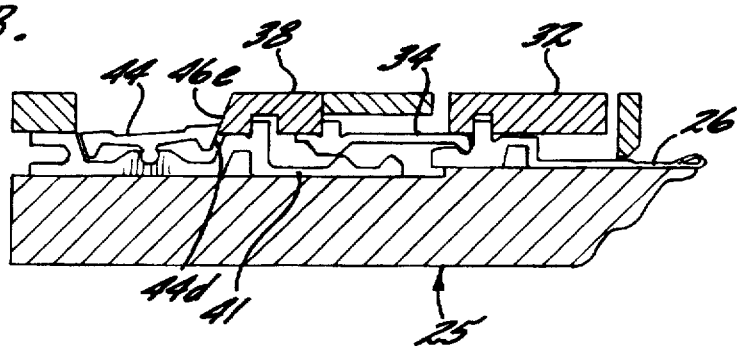
Figure 5C:
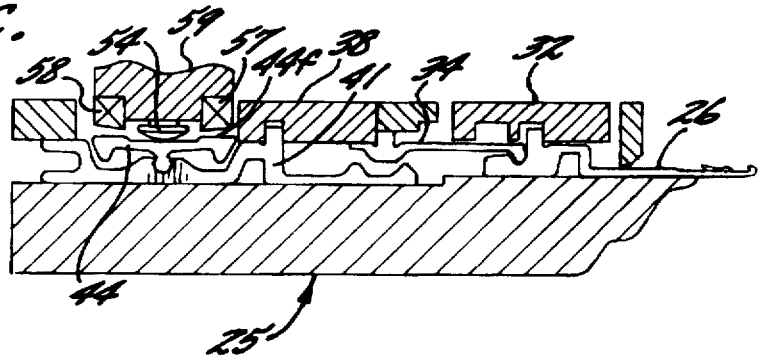

Rocker bar 44 then moves past electromagnet 55 and the wedge-shaped end 44*d* of rocker bar 44 engages protrusion 46*e* of side edge 46*b* of cam 46. Rocker bar 44 is thus pushed inwardly of the knitting machine 20 along with rocker base 40 (FIG. 5B). Selector jack 34 has the projection 34*d* thereon riding up on projection 41*b* of rocker base 40 as rocker base 40 moves to the left as seen in FIG. 5B. This positions butt 34*a* on selector jack 34 to engage first rising part 38*a* of selector jack raising cam 38 and selector jack 34 moves to the tuck position along with dial needle 26. Dial needle 26 is pivotally linked to selector jack 34 by portion 34*e* and recess 26*b* (FIG. 5C).

Figure 5D:
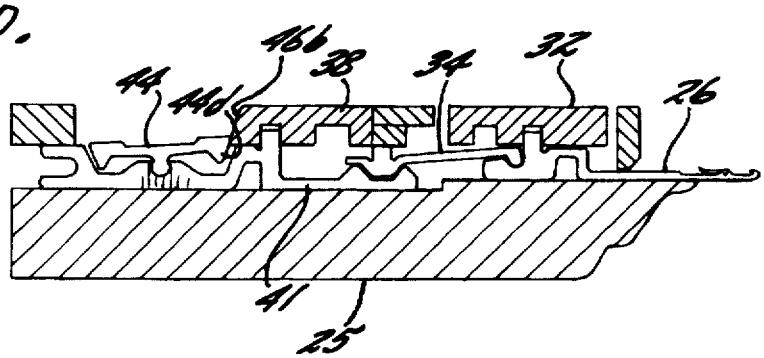
Figure 5E:
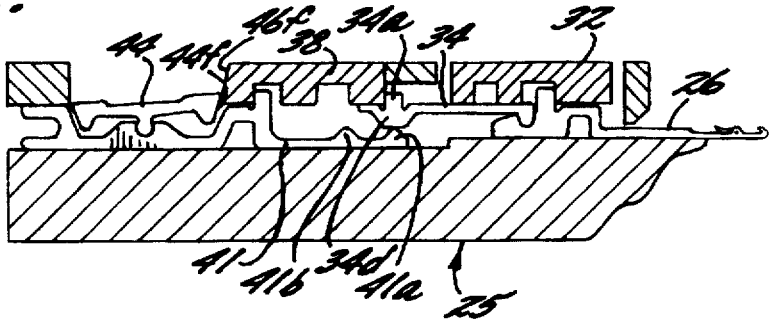
Figure 5F:
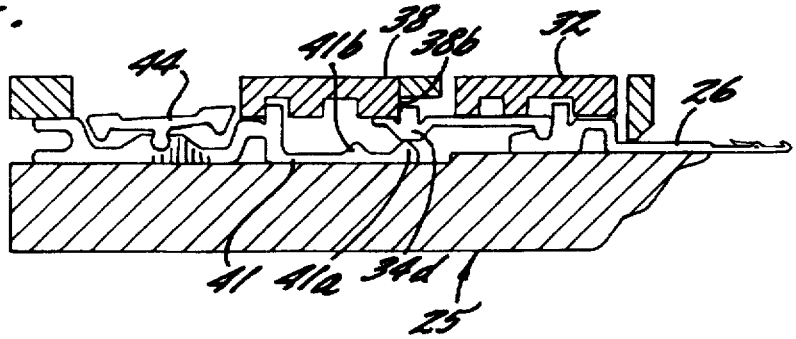

Next, signals are sent to electromagnet 57 which attracts attractable portion 44*f* of rocker bar 44 (FIG. 5D). As rocker bar 44 passes electromagnet 57, the wedge end 44*d* engages the second protrusion 46*f* of side edge 46*b* of cam 46 and rocker bar 44 and rocker base 40 are pushed inward (FIG. 5D). Such inward movement of rocker base 40 causes projection 34*d* on selector jack 34 to ride up on projection 41*a* on rocker base 41 (FIG. 5E). Butt 34*a* on selector jack 34 engages the second rising part 38*b* on cam 38, and selector jack 34 moves dial needle 26 from the tuck position to the knit position (FIG. 5F).

Figure 5G:
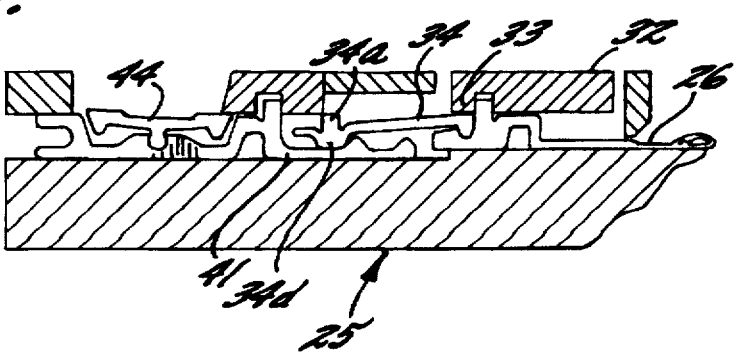
FIG. 5G is a sectional view similar to FIG. 5F in a different operational position.

Once the dial needle 26 is moved to the knit position by the selector jack 34, it is lowered to the welt position by outer guard cam 32 and stitch cam 33 (FIG. 5G). The pattern selection means is then in position for the next needle selection cycle.

Figure 5H:
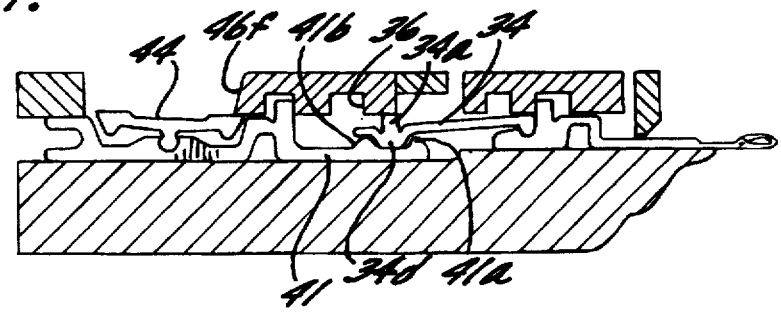
FIG. 5H is a sectional view similar to FIG. 5E in a different operational position.

If it is desired that dial needle 26 be moved only to the tuck position, the dial needle 26 is moved to the tuck position as described above in connection with FIGS. 5A–5C. However, instead of electromagnet 57 being energized as described previously, electromagnet 58 is energized to attract attractable portion 44*g* of rocker bar 44 (FIG. 5H). At the same time, cancelling cam 36 in cam track $T_2$ pushes down butt 34*a* on selector jack 34 which causes projection 34*d* on selector jack 34 to remain in the recessed space between projection 41*a* and 41*b*. Concurrently, the opposite end of rocker bar 44 passes beneath projection 46f on side edge 46b of cam 46. Therefore, the dial needle 26 remains in the tuck position until dial needle 26 is lowered to the welt position by the stitch cam 33.

If it is desired for the dial needle 26 to maintain the welt position, signals are sent to electromagnet 56 which attracts attractable portion 44g of rocker bar 44. At the same time, cancelling cam 37 in cam track $T_2$ lowers butt 34a of selector jack 34 and selector jack projection 34d remains to the left of projection 41b on rocker base 41 (FIG. 5G). Concurrently, the opposite end of rocker bar 44 passes beneath projection 46e on side edge 46b of cam 46. The dial needle 26 will not be affected by the rocker base 40 and will not move from the welt position.

In FIG. 1, the lines $T_{1k}$, $T_{1t}$ and $T_{1w}$ indicate the tracks of butt 26a of dial needle 26 as it moves with dial 25 and as dial needle 26 is moved between these three positions. The lines $T_{3k}$, $T_{3t}$ and $T_{3w}$ indicate the tracks of butt 42 on rocker base 40 as rocker base 40 moves with dial 25 and is moved by cam projections 46e and 46f and by cam track $T_3$ to positions corresponding to the knit, tuck and welt positions of dial needle 26.

Figure 6:
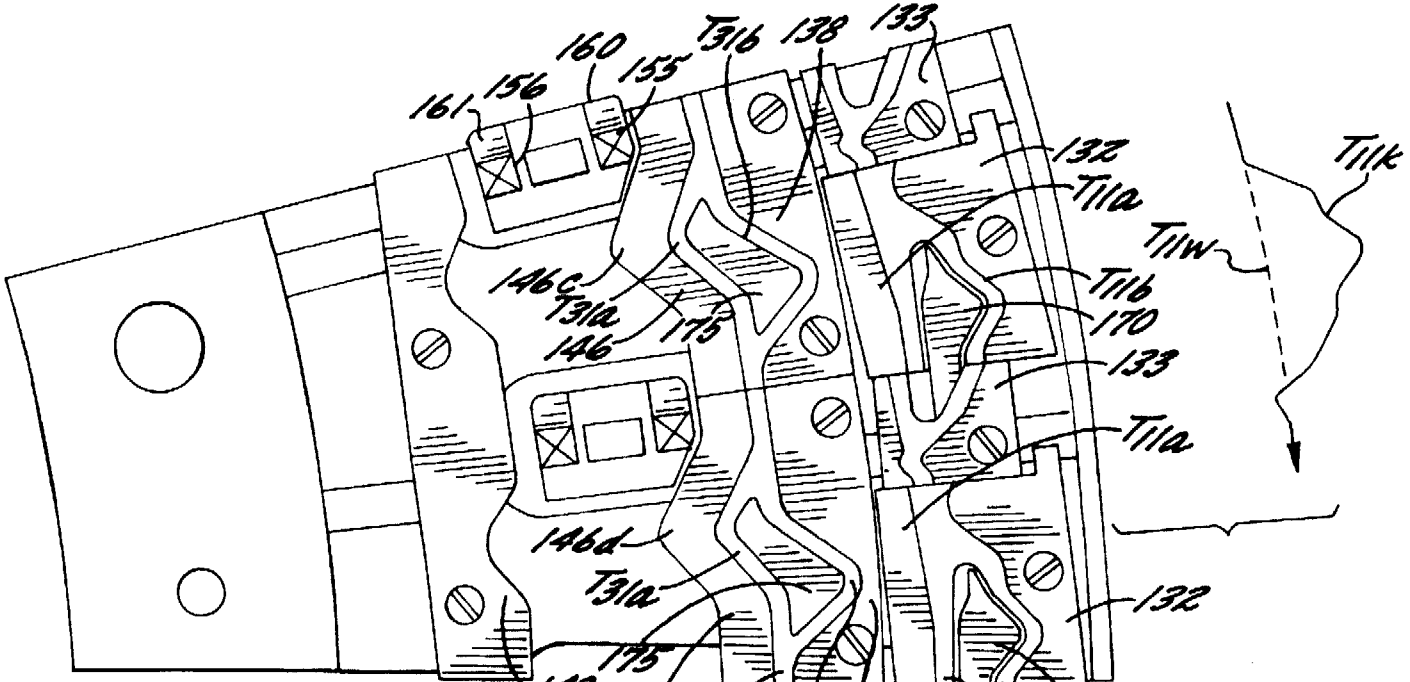
FIG. 6 is a view similar to FIG. 1 of another embodiment of the jacquard pattern control mechanism and particularly a cam block and control cams for a knitting needle.
Figure 7:
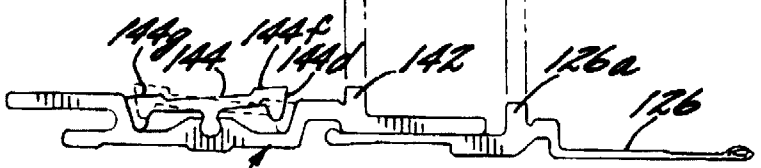
FIG. 7 is a view similar to FIG. 4 of a knitting needle and associated pattern control instrumentalities for use in the embodiment illustrated in FIG. 6.

Referring now to FIGS. 6 and 7 in which another embodiment of the present invention is illustrated, there is shown a jacquard pattern mechanism for a knitting needle 126 which is slidably mounted in a groove in a knitting machine. In this same groove with needle 126 is a rocker base 140 on which is pivotally mounted a rocker bar 144. Rocker base 140 and rocker bar 144 control the needle 126 to be in either the knit position or the welt position.

Needle 126 has a butt 126a thereon which is controlled by needle control cams 131 which include outer guard cams 132, stitch cams 133 and needle raising cams 170 defining a cam track $T_{11}$ having a first branch $T_{11a}$ and a second branch $T_{11b}$.

Rocker base control cams 138, 146 and 175 define a branched cam track $T_{31}$ having a first branch $T_{31a}$ between rocker base raising cams 175 and cam 146 and branch $T_{31b}$ between cams 175 and 138. Cam 146 has a first side edge 146a and a second side edge 146b. Second side edge 146b has a first projection 146c and a second projection 146d. Second side edge 146b and a cam 148 define a cam track $T_{41}$ in which the rocker bar 144 travels.

A first electromagnet 155 and a second electromagnet 156 are provided in cam track $T_{41}$ immediately upstream of first projection 146c on second side edge 146b of cam 146. Cancelling cams 160 and 161 precede the electromagnets 155 and 156.

If needle 126 is to remain in the welt position, electromagnet 155 is energized to attract attractable portion 144f of rocker bar 144. The wedge end 144d of rocker bar 144 engages first projection 146c of second side edge 146b of cam 146, and rocker bar 144 and rocker base 140 are moved inwardly or downwardly. Needle 126 is not affected by inward or downward movement of rocker base 140 and thus remains in the welt position $T_{11w}$ by the butt 126a passing along branch $T_{11a}$ of cam track $T_{11}$.

If needle 126 is to be moved to the knit position, electromagnet 156 is energized to attract attractable portion 144g of rocker bar 144. The other end of rocker bar 144 passes beneath projection 146c on second side edge 146b of cam 146 and control butt 142 on rocker base 140 engages the upward slant 175a of rocker base raising cam 175 and moves upwardly. Butt 126a on needle 126 is moved upwardly and enters branch $T_{11b}$ of cam track $T_{11}$ and engages needle raising cam 170 and moves to the knit position $T_{11k}$ (FIG. 6). In this way, two positions, i.e. welt and knit positions, can be selected.

Preferably, needle raising cam 170 and rocker base raising cam 175 are supported by springs (not shown). Therefore, when an abnormal force is applied to these cams, they are pulled back, thereby avoiding any significant damage to the butt 142 on rocker base 140 or to butt 126a on needle 126.

If needle raising cam 170 is maintained in its pulled back position and electromagnet 156 is energized, rocker bar 144 will pivot such that the end opposite attractable member 144g will pass beneath projection 146c, and control butt 142 of rocker base 140 will engage rocker base raising cam 175 and raise needle 126 to the tuck position. Therefore, in this mode, the needle 126 can be selected for two positions, i.e. the welt and tuck positions.

Figures 8, 9:
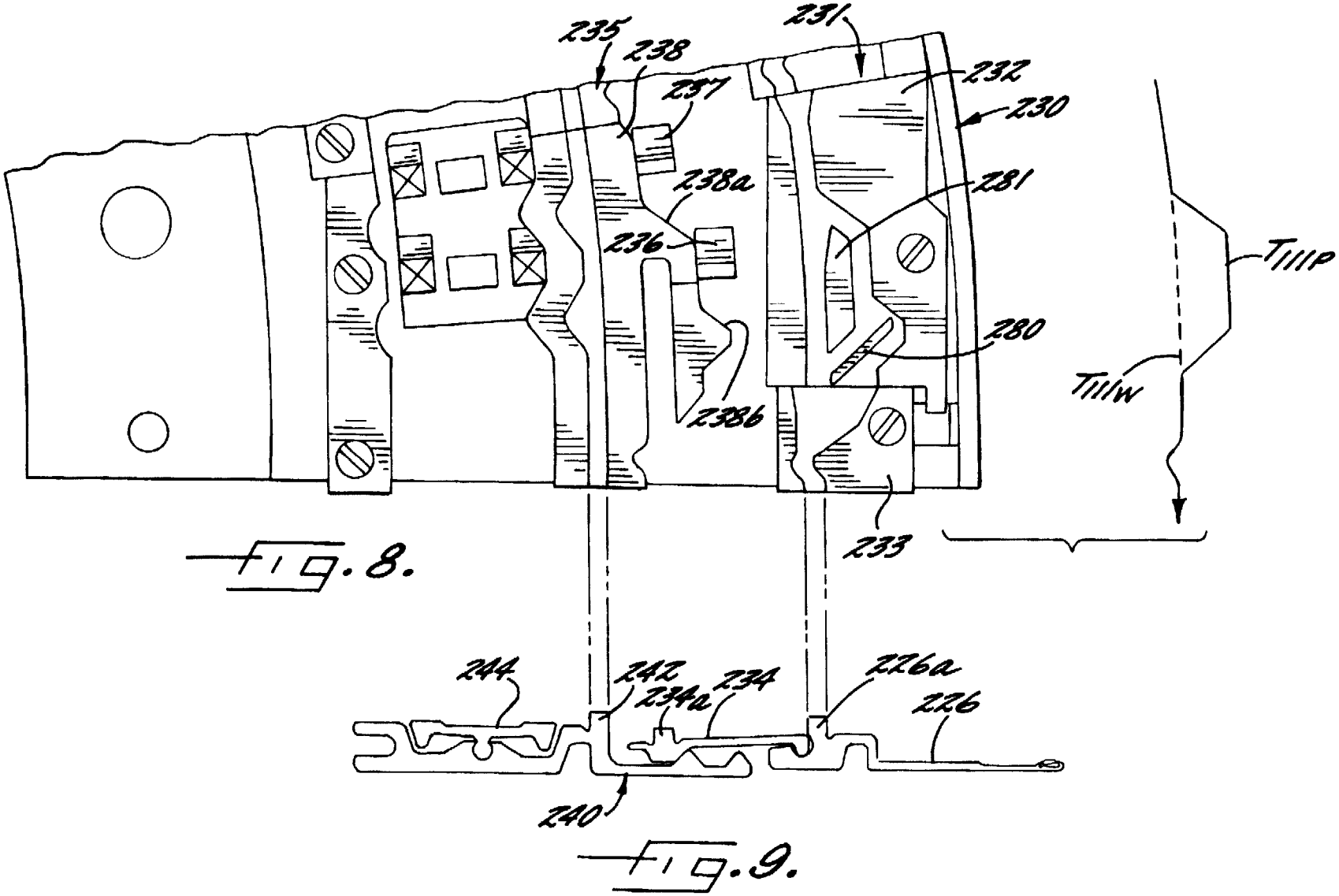
FIG. 8 is a view similar to FIG. 6 of a further embodiment of the present invention.
FIG. 9 is a view similar to FIG. 7 of the knitting needle and pattern control mechanism of the embodiment illustrated in FIG. 8.

Referring now to FIGS. 8 and 9, there is illustrated a further embodiment of this invention. In this embodiment, a knitting needle 226 is provided and has a butt 226a thereon. A selector jack 234 is substantially identical to the previously described selector jack 34 and has a butt 234a thereon. A rocker base 240 is also substantially identical to rocker base 40 and has a butt 242 thereon. A rocker bar 244 is pivotally carried by rocker base 240 and is substantially identical to rocker base 40.

Needle control cams 231 are provided and include outer guard cams 232, stitch cams 233, inner guard cams 280, and tuck cams 281, all of which define a cam track $T_{111}$. Cam track $T_{111}$ receives butt 226a on needle 226 and moves needle 226 between the welt and knit positions.

Selector jack control cams 235 are provided on cam block 230 and include selector jack cancelling or deflecting cams 236 and 237 and selector jack raising cams 238. Selector jack raising cam 238 is formed in two parts, the first part 238a being a tuck-raising part and the second part 238b being a knit-raising part near the top of the tuck position.

For support needle selection of needle 226, selector jack 234 is caused to rise up part 238a of cam 238 to the tuck position. Part 238b of cam 238 is withdrawn to a position where it will not be engaged by butt 234a on selector jack 234 such that needle 226 remains in the tuck position. Needle butt 226a moves along tuck cam 281 and outer guard cam 232 until it engages inner guard cam 280 which causes the needle 226 to be lowered toward the welt position. The track of butt 226 of needle 226 along cam track $T_{111}$ is represented in FIG. 8 as $T_{111s}$ while the welt position track is indicated as $T_{111w}$. This pattern selection mode permits the selection of two positions, i.e. the support position and the welt position. However, if inner guard cam 280 is withdrawn to a position out of the path of butt 226 of needle 226, then three positions can be selected.

As described herein, the pattern control mechanism of the present invention permits needle or other knitting instrumentality selection for three positions, i.e. welt, tuck and knit (or even support) based upon pattern signals from a controller to produce a jacquard fabric of a variety of different patterns. While principally described herein in association with dial needles, the present invention is not confined thereto, but can be widely applied to guiding selectively any knitting instrumentality, including cylinder needles, transfer needles, jacks, sinkers, etc. through at least two paths and usually three such paths.

The present invention provides numerous advantages not previously available. For example, the depth stroke of the rocker cam 146 can be decreased to the level equivalent to the stroke of projection 134d on selector jack 34 when it moves up projections 41a or 41b. The circumferential stroke of rocker cam 46 or 146 can also be shortened. As a result, the needle selecting parts of the needle selection mechanism necessary for selecting three positions can be made compact. Therefore, three positions of the needles can be selected using the same number of yarn feeds which heretofore could be selected for only two positions.

Additionally, prior needle selection mechanisms placed an inordinate load on the rocker bar during the knitting operation since all of the load on the needles was transferred to the rocker bar. In accordance with the present invention, that load is borne by the rocker base 140 and the rocker base raising cam 175. Therefore, the rocker 144 bears only the load of the weight of the rocker base 140 and of the rocker 144 itself.

In the drawings and specifications, there has been set forth a preferred embodiment of the invention, and although specific terms are employed, they are used in a generic and descriptive sense only and not for purposes of limitation, the scope of the invention being set forth in the following claims.

We claim:

1. A jacquard pattern control mechanism for a circular knitting machine having movable knitting instrumentalities, said pattern control mechanism comprising a rocker base movably mounted in spaced relation to each of said knitting instrumentalities for sliding movement in alignment with and in the same directions as the knitting instrumentality moves, a selector jack mounted between said rocker base and said knitting instrumentality for assisting in controlling the selection and movement of the knitting instrumentality, a rocker bar pivotally mounted on said rocker base for rocking movement about a medial pivot relative to said rocker base and having attractable portions on opposite end portions thereof which when attracted cause said rocker bar to rock about its pivot, magnetic attracting means mounted adjacent said attractable portions of said rocker bar for attracting selectively said attractable portions, first control cam means for controlling said knitting instrumentalities, second control cam means for controlling said selector jack, and intermediate cam means for controlling said rocker base and for moving said rocker base as said rocker base engages with and disengages from said selector jack so that the circumferential stroke may be shortened and three positions of said knitting instrumentality selected.

2. A pattern control mechanism according to claim 1 wherein said selector jack includes a butt projecting from one side thereof, and a circular projection extending from the other side of said selector jack at one end thereof and adapted to be received in a semicircular recess in the knitting instrumentality to connect said selector jack to said knitting instrumentality.

3. A pattern control mechanism according to claim 2 wherein said selector jack also includes an inverse trapezoidal projection extending from said other side thereof in spaced relation to said circular projection, and wherein said rocker base has a pair of spaced apart trapezoidal projections on a side thereof adjacent said selector jack projection, said selector jack projection being receivable in the space between said rocker base projections and a space to one side of one of said rocker base projections, said selector jack being moved away from said rocker base upon relative movement of said rocker base and said selector jack by coaction between said selector jack and rocker base projections.

4. A jacquard pattern control mechanism for a circular knitting machine having movable knitting instrumentalities, said pattern control mechanism including a rocker base mounted for movement in alignment with and in the same direction as each knitting instrumentality, a rocker bar pivotally mounted on said rocker base for rocking movement about a pivot and having a pair of attractable portions on opposite sides of said pivot which when attracted cause said rocker bar to rock about said pivot, magnetic attracting means mounted adjacent a path of travel of said attractable portions of said rocker bar for attracting selectively said attractable portions to rock said rocker bar, controlling cam means for controlling the knitting instrumentalities, intermediate cam means for controlling said rocker base, and rocker bar control cam means for lowering said rocker bar upon selective attraction of one of said attractable portion of said rocker bar.

5. In a circular knitting machine having knitting instrumentalities for forming knit fabric including a rotating member having a plurality of grooves in which said knitting instrumentalities are slidably mounted, the improvement comprising control means for controlling said knitting instrumentalities to produce jacquard knit fabric, said control means comprising a plurality of rocker bases each slidably mounted in the same groove as one of said knitting instrumentalities, each of said rocker bar supporting members including a butt protruding therefrom, a plurality of elongate rocker bars having magnetically attractable opposite end portions and each being pivotally mounted on one of said rocker bases for movement about a medial pivot, opposite end portions of said rocker bar being adapted to be selectively moved between operative and inoperative positions, magnetic attracting means operatively associated with said opposite end portions of said rocker bars for selectively attracting one of said magnetically attractable opposite end portions to pivot said rocker bars and selectively move one of said opposite end portions to said operative position and the other of said opposite end portions to said inoperative position, rocker bar operating cam means engageable with one end portion of said rocker bar in said operative position for lowering said rocker bar and said rocker base to a retracted position to maintain said knitting instrumentality in a welt position and for moving said rocker base to an extended position to move said knitting instrumentality upon said other end portion of said rocker bar to said operative position, and control cam means engageable with said knitting instrumentalities upon movement thereof by said rocker bases for moving said knitting instrumentalities to a knitting position.

6. A circular knitting machine according to claim 5 wherein said rotating member comprises a dial and said knitting instrumentalities comprise dial needles.

7. A circular knitting machine according to claim 5 wherein said rotating member comprises a needle cylinder and said knitting instrumentalities comprise cylinder needles.

8. A circular knitting machine according to claim 5 including a selector jack having a butt thereon slidably mounted in each of said grooves between said knitting instrumentality and said rocker base and intermediate cam means for moving said selector jack from a retracted position to an extended position.

9. A circular knitting machine according to claim 5 wherein said opposite end portions of said rocker bar have a beveled wedge shape and wherein said rocker bar operating cam means has at least one projection in a side edge thereof facing said rocker bar.

10. A circular knitting machine according to claim 5 wherein said magnetic attracting means comprises a permanent magnet and first and second electromagnets disposed on opposite sides of said permanent magnet.

11. A circular knitting machine according to claim 10 wherein said permanent magnet has an outer tip adjacent said rocker bar which has a mushroom-shaped cross section.

12. A circular knitting machine according to claim 5 wherein said magnetic attracting means comprises a first permanent magnet and a first pair of electromagnets on opposite sides of said permanent magnet and a second permanent magnet spaced downstream from said first permanent magnet and a second pair of electromagnets on opposite sides of said second permanent magnet.

13. A circular knitting machine according to claim 5 wherein said rocker base has first and second spaced apart trapezoidal projections on the side thereof having said butt thereon, and including a selector jack positioned between said rocker base and said knitting instrumentality, and having a butt thereon, said selector jack having a trapezoidal projection on the side thereof adjacent said rocker base and coacting with said projections on said rocker base to move said selector jack away from said rocker base upon relative movement of said rocker base and said selector jack.

14. A circular knitting machine according to claim 13 including selector jack control cam means for engaging said butt on said selector jack for moving said selector jack and said knitting instrumentality from a welt position to a tuck position when said selector jack is moved away from said rocker base by said first projection on said rocker base.

15. A circular knitting machine according to claim 14 wherein said selector jack control cam means includes cancelling cam means for moving said selector jack back toward said rocker base when it is desired to maintain said knitting instrumentality in the tuck position.

16. A circular knitting machine according to claim 15 wherein further relative movement of said rocker base relative to said selector jack causes coaction between said projection on said selector jack and said second projection on said rocker base to move said selector jack away from said rocker base.

17. A circular knitting machine according to claim 16 wherein said selector jack control cam means moves said selector jack and said knitting instrumentality from the tuck position to a knit position upon movement of said selector jack away from said rocker base by said second projection on said rocker base.

18. A circular knitting machine according to claim 17 wherein said knitting instrumentality control cam means moves said knitting instrumentality from the knit position to the welt position.

* * * * *